US009923315B2

(12) United States Patent
Grassl et al.

(10) Patent No.: US 9,923,315 B2
(45) Date of Patent: Mar. 20, 2018

(54) LOW PASSIVE INTERMODULATION COAXIAL CONNECTOR TEST INTERFACE

(71) Applicant: SPINNER GmbH, München (DE)

(72) Inventors: Martin Grassl, Erding (DE); Wolfgang Zissler, Feldkirchen-Westerham (DE); Andreas Grabichler, Buckmühl (DE)

(73) Assignee: SPINNER GmbH, München (DE)

( * ) Notice: Subject to any disclaimer, the term of this patent is extended or adjusted under 35 U.S.C. 154(b) by 0 days.

(21) Appl. No.: 15/655,064

(22) Filed: Jul. 20, 2017

(65) Prior Publication Data

US 2017/0324197 A1 Nov. 9, 2017

Related U.S. Application Data

(63) Continuation of application No. PCT/EP2016/050451, filed on Jan. 12, 2016.

(30) Foreign Application Priority Data

Jan. 22, 2015 (EP) ..... 15152199
Nov. 23, 2015 (EP) ..... 15195915

(51) Int. Cl.
*H01R 24/40* (2011.01)
*H01R 103/00* (2006.01)

(52) U.S. Cl.
CPC ..... *H01R 24/40* (2013.01); *H01R 2103/00* (2013.01)

(58) Field of Classification Search
CPC .... H01R 2103/00; H01R 24/40; H01R 24/50; H01R 9/05; H01R 9/0521; H01R 9/0518; H01R 13/622; H01R 24/38; H01R 9/0524; H01R 13/6275; H01R 12/716; H01R 13/5219; H01R 13/6277; H01R 13/6581
See application file for complete search history.

(56) References Cited

U.S. PATENT DOCUMENTS 2,762,025 A 9/1956 Melcher
3,871,735 A 3/1975 Herrmann, Jr.
4,106,839 A * 8/1978 Cooper ..... H01R 13/65802 439/607.18
4,355,857 A * 10/1982 Hayward ..... H01R 13/646 439/578
4,374,606 A 2/1983 Lathrop
4,812,137 A 3/1989 Wilson et al.
5,195,904 A * 3/1993 Cyvoct ..... H01R 13/6277 439/349
6,344,736 B1 2/2002 Kerrigan et al.
(Continued)

*Primary Examiner* — Truc Nguyen
(74) *Attorney, Agent, or Firm* — Yakov S. Sidorin; Quarles & Brady LLP

(57) ABSTRACT

A coaxial RF test connector comprises an inner conductor and an outer conductor arranged coaxially with respect to a center axis. The outer conductor includes a groove dimensioned to hold a circularly shaped contact spring. The contact spring includes a base portion and a plurality of arc-shaped contact fingers extending from the base with gaps between the individual contact fingers. The base has a radius larger than that at which the contact fingers are bent. The contact fingers have first contact section for contacting the outer conductor of a compatible coaxial connector in a direction radial to the center axis, and a second contact section for capacitively coupling to a sidewall of the groove.

9 Claims, 7 Drawing Sheets

(56) References Cited

U.S. PATENT DOCUMENTS

| | | | | |
|---|---|---|---|---|
| 6,379,183 | B1 * | 4/2002 | Ayres | H01R 9/0515 439/578 |
| 7,794,274 | B2 * | 9/2010 | Phillips, Jr. | H01R 13/187 439/578 |
| 9,124,010 | B2 * | 9/2015 | Eriksen | H01R 9/0524 |
| 2013/0065415 | A1 | 3/2013 | Van Swearingen et al. | |
| 2013/0130543 | A1 | 5/2013 | Holland et al. | |
| 2015/0229070 | A1 * | 8/2015 | Van Swearingen | H04B 5/0012 439/320 |
| 2015/0270635 | A1 * | 9/2015 | Wollitzer | H01R 13/2421 439/675 |

* cited by examiner

LOW PASSIVE INTERMODULATION COAXIAL CONNECTOR TEST INTERFACE

CROSS-REFERENCE TO RELATED APPLICATIONS

This application is a continuation of the pending International Application No. PCT/EP2016/050451 filed on Jan. 12, 2016 and now published as WO 2016/116326, which designates the United States and claims priority from the European Application No. 15152199.4, which was filed on Jan. 22, 2015 and the European Application No. 15195915.2, which was filed on Nov. 23, 2015. The disclosure of each of the above-mentioned applications is incorporated by reference herein.

BACKGROUND

1. Field of the Invention

The invention relates to a coaxial test connector configured for easy and quick connection to a test object. It further relates to a self-aligning coaxial connector, i.e. a connector, which automatically aligns to a mating connector during the coupling operation.

2. Description of Relevant Art

For testing electronic devices test adapters are often used. These test adapters connect with devices to be tested to external test equipment. When testing RF devices like amplifiers, filters or others, these often have to be connected by RF connectors, which in most cases are coaxial connectors. These have comparatively tight mechanical tolerances and require a precise connection. When the connectors are attached manually to the device to be tested, the test adapter's connectors have flexible cables and are manually attached to the device to be tested. If an automatic connection between a device to be tested and a test adapter is desired, mechanical tolerances may cause severe problems. Basically, a test adapter may be built with close mechanical tolerances, but the devices to be tested are often manufactured in larger quantities and often have wider mechanical tolerances. This may lead to a misalignment of the connectors which may further lead to a damage of the connectors or to incorrect test results. Generally it would be preferred, if the connectors of the measuring adaptor and the mating connectors of the device to be tested are exactly aligned in all planes and directions.

U.S. Pat. No. 6,344,736 B1 discloses a self-aligning connector. The connector body is held over an outer radial flange, provided at its outer surface, between an inner radial flange provided at the inner surface of the connector housing and a washer pressed by an axial spring, so that it can align to a mating connector being inserted into the centering collar fixed to the connector body at least axially and in the transverse plane.

To provide a low passive intermodulation (PIM) connection, comparatively high contact forces are applied to normal coaxial RF connectors. In normal use, such forces are applied by the connector's locking nut which is tightened with a predetermined and comparatively high torque. In a test setup, locking the connectors is too time consuming. Simply pressing the connectors together would require a pressure device generating high pressure in axial direction of the connector. This is hardly feasible specifically in devices with a large number of connectors.

U.S. Pat. No. 4,374,606 discloses a coaxial connector with a plurality of contacts configured to radially contact an outer conductor. The contacts are held by a sleeve in axial direction. The sleeve engages slidably in an outer conductor.

U.S. Pat. No. 4,106,839 discloses a shielded multipole connector having a contact spring which connects the shields of mating connectors.

SUMMARY

The embodiments are based on the object of providing a coaxial RF connector interface having high return loss in a broad frequency range and a low passive intermodulation which can be connected and disconnected by applying comparatively low forces. Preferably, the connection should be maintained without applying significant forces in an axial direction of the connector. Furthermore, the connector should have a long lifetime with a large number of mating cycles as are required for test equipment.

In an embodiment, a test connector is configured to connect to an auxiliary, compatible coaxial connector along the axis of the test connector, for example to be part of a device to be tested. The test connector provides at least an inner conductor and an outer conductor, most preferably, both conductors have a circular cross section and/or a cylindrical shape and may be inserted inwardly into another, auxiliary test connector (in an inward, axial direction to have the auxiliary, compatible test connector at least partially enclose the inner and outer conductors of the test connector at hand). In other words, the outer conductor has a circular shape configured to at least partially enclose the outer conductor of the compatible coaxial connector in a radial direction. The outer conductor further provides a groove configured to hold an approximately circularly shaped spring which is dimensioned to radially contact the outer conductor of the compatible coaxial connector and assert or apply an approximately radially-directed contact force to said outer conductor.

Preferably, the contact spring is a finger gasket. Preferably, the contact spring has a plurality of individual contact fingers with a preferably small gap between the individual contact fingers. The contact fingers may have additional contact elements or contact points at their outer sides to improve contacting of the compatible coaxial connector. It is preferred, that the widths of all or at least of most of the gaps between the individual contact fingers is less than the width of a finger, preferably equal or less than half and most preferably less than ⅓ of the width a finger. It is further preferred to have the widths of all or at least of most of the fingers finger be less than 1 mm and preferably less than or equal to 0.5 mm. Furthermore, the individual contact fingers preferably are arranged as part of a common base and, therefore, are held together by the common base. It is preferred to have the base be held by the test connector and the contact fingers be pressed radially against the outer conductor of the compatible, auxiliary coaxial connector. Preferably, the contact fingers extend by a bow (in a curved fashion) from the base.

Preferably, at least one of the contact fingers includes a first contact section dimensioned to contact the compatible coaxial connector in a radial direction, when such compatible connector is attached. Such contact finger(s) further comprise(s) a second contact section dimensioned to contact a sidewall of the groove formed in the outer conductor. Most preferably, the second contact section is in capacitive contact with the sidewall of the groove, although a galvanic contact may also be useful (preferably at lower frequencies, such as within the range from kHz to MHz or even lower). Most preferably, the sidewall of the groove is oriented in outward direction (opposing the inward direction), therefore facing in a direction towards the compatible connector with which the test connector at hand can be axially interconnected. As a result of establishing the contact between the second contact section and the sidewall, an area forming a current loop by the current flowing from the outer conductor of the compatible connector to the test connector is reduced, which further increases a bandwidth of the connector (or a bandwidth corresponding to a combination of connectors).

FIG. 10 shows an embodiment without the capacitive contact present between the second contact section 223 and the sidewall 58, which results in large current loop area 241.

In another related embodiment, the outer conductor of the test connector may contains a spring holder being part of or forming the groove, which holds the contact spring. Preferably, the contact spring is soldered and/or welded to the spring holder. Most preferably, it is soldered and/or welded at its base to the spring holder. Solder may be applied radially outside of the base of the contact spring to the spring holder. To achieve better intermodulation characteristics (of the interconnected connector units), only one metallurgical connection (the solder connection) between the contact spring and the spring holder can be established. To provide a capacitive contact and to prevent any galvanic contact in an axial direction, an insulating disk may be placed between the bow of the contact spring and the spring holder. Such insulating disk may comprise a suitable insulating material, which may be ceramics, or a plastic material, which may be PTFE or Polyimide. Furthermore, in one embodiment it is preferred if the insulating disc has a high dielectric constant to establish a high coupling capacity between the spring and the spring holder. It may be further preferred, if the spring holder has a thread interfacing with a thread at the outer conductor of the test connector. Such configuration allows the spring holder to be screwed (preferably in an axial direction of the connector) on the outer conductor.

In an alternative embodiment, the spring holder may be pressed, soldered, or welded to the outer conductor of the test connector.

In yet another related embodiment, the spring holder may be structured to be a part of the outer conductor of the test connector providing a circular gap or groove configured to hold the contact spring. In this case, the contact spring preferably has a shape and size dimensioned such that—when the compatible coaxial connector is inserted into the test connector—the axial force between the contact spring and the outer conductor of the test connector is sufficiently large to deform the contact spring, such that it further asserts a significant force to the outer conductor of the test connector to ensure proper and operably sufficient contacting. This may be achieved by arcuately shaping the fingers.

The disclosed embodiments have the advantage in that the contact spring can easily be mounted into the test connector. It is not necessary to solder or weld the contact spring into the test connector. The contact spring can withstand a large number of mating cycles (between the two compatible connectors) without suffering from being materially fatigued or starting to initiate poor contacts.

Preferably, the base has a larger radius than that of the contact fingers, with respect to the center axis. Therefore, preferably, the base is essentially radially enclosing the contact fingers. This results in a very compact size of the overall assembly and short current paths between the outer conductors of the compatible coaxial connector and the test connector, which in turn leads to good impedance matching in a broad range of frequencies and, therefore, high return loss.

It is further preferred, if the number of contact fingers is higher than 10, preferably higher than 20 and most preferably higher than 40 to achieve a low impedance broadband contact.

It is further preferred, if the outer conductor of the test connector has at least one contact section configured to provide a mechanical contact to, and therefore a mechanical alignment with, the compatible coaxial connector. It is further preferred, if the spring holder provides at least one such a contact section. Preferably, there is at least one radial contact section configured to provide a radial alignment of the compatible coaxial connector and the test connector. It is further preferred, if there is at least one axially oriented contact section configured to establish axial alignment between the compatible coaxial connector and the test connector at hand.

In a further related embodiment, the test connector provides a connector guide configured to guide the compatible coaxial connector towards the test connector during the process of insertion of the compatible coaxial connector into the test connector. It is further preferred, if the connector guide has a cone-shaped entrance side to simplifying such insertion of alignment with the compatible coaxial connector.

Independently of the previously described embodiments, the center conductor may either be of a male type or a female type.

In one embodiment, the contact spring is made of at least one of the following materials: copper-beryllium, brass, steel.

Alternatively or in addition, the compatible coaxial connector is a 7/16 DIN connector, as specified in the German standard DIN 47223.

BRIEF DESCRIPTION OF THE DRAWINGS

In the following portion of the disclosure, the invention will be described without limitation of the general inventive concept, with the use of examples of embodiments and with reference to the following drawings.

Various modifications and alternative forms can be introduced to the examples of embodiments discussed below without limiting the scope of the invention to the particular discussed example. To the contrary, the scope of the intention is intended to cover all modifications, equivalents and alternatives falling within the spirit and scope defined by the appended claims.

DETAILED DESCRIPTION

Figure 1:
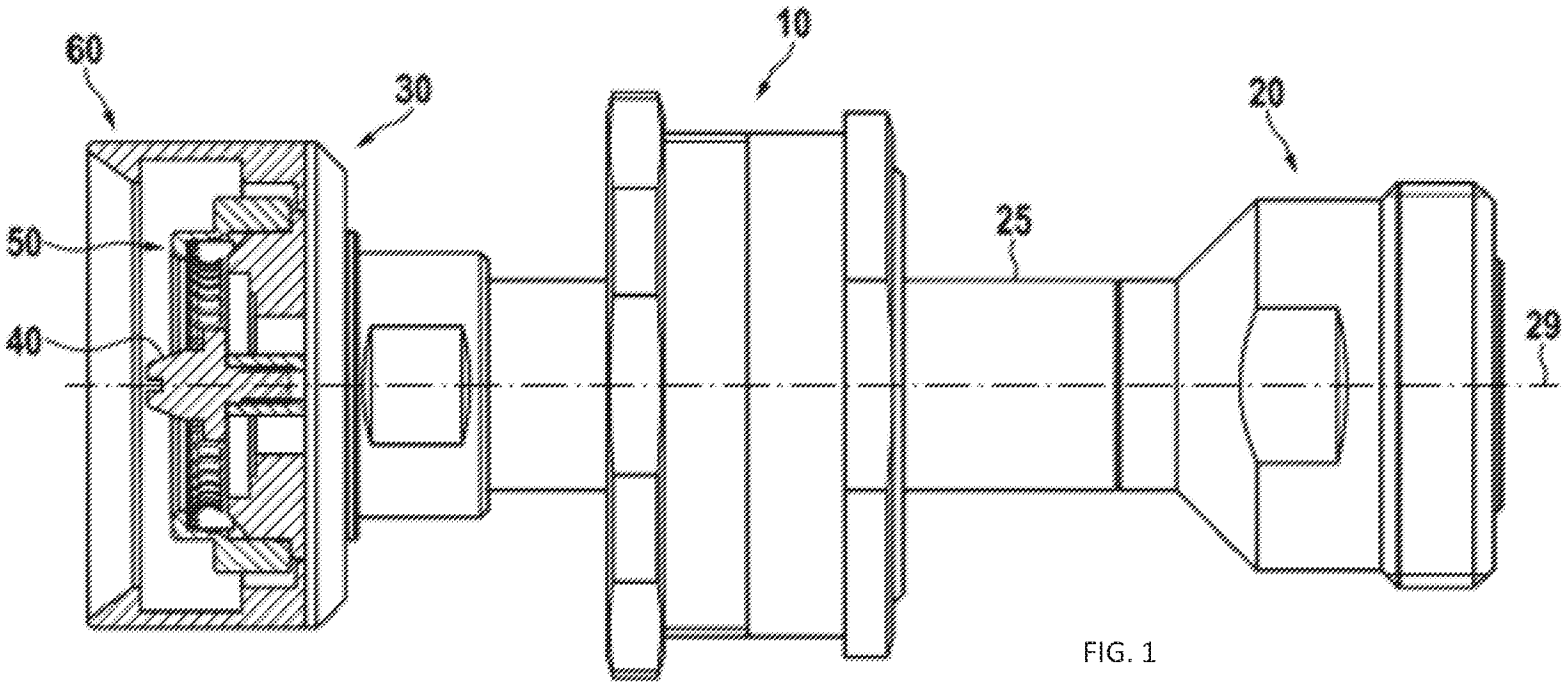
FIG. 1 shows an embodiment of a test connector assembly.

In FIG. 1, a preferred embodiment of a test connector assembly is shown. A test connector 30 is connected to an internal connector 20 by means of a connecting line component 25, which has a center axis 29, and which is held by a mounting suspension 10. The mounting suspension 10 is configured to optionally allow tilting of the connecting line component 25 and further allow a displacement thereof along the center axis 29. The test connector assembly is further structured to allow the application of force to the test connector 30 to simplify establishing a contact between a compatible coaxial connector 100, as will be shown in the next figure. Preferably, the test connector 30 comprises an inner conductor 40 and an outer conductor 50. It is further preferred, if the test connector 30 comprises a connector guide 60 configured to guide a compatible coaxial connector 100 when mating the connectors.

Figure 2:
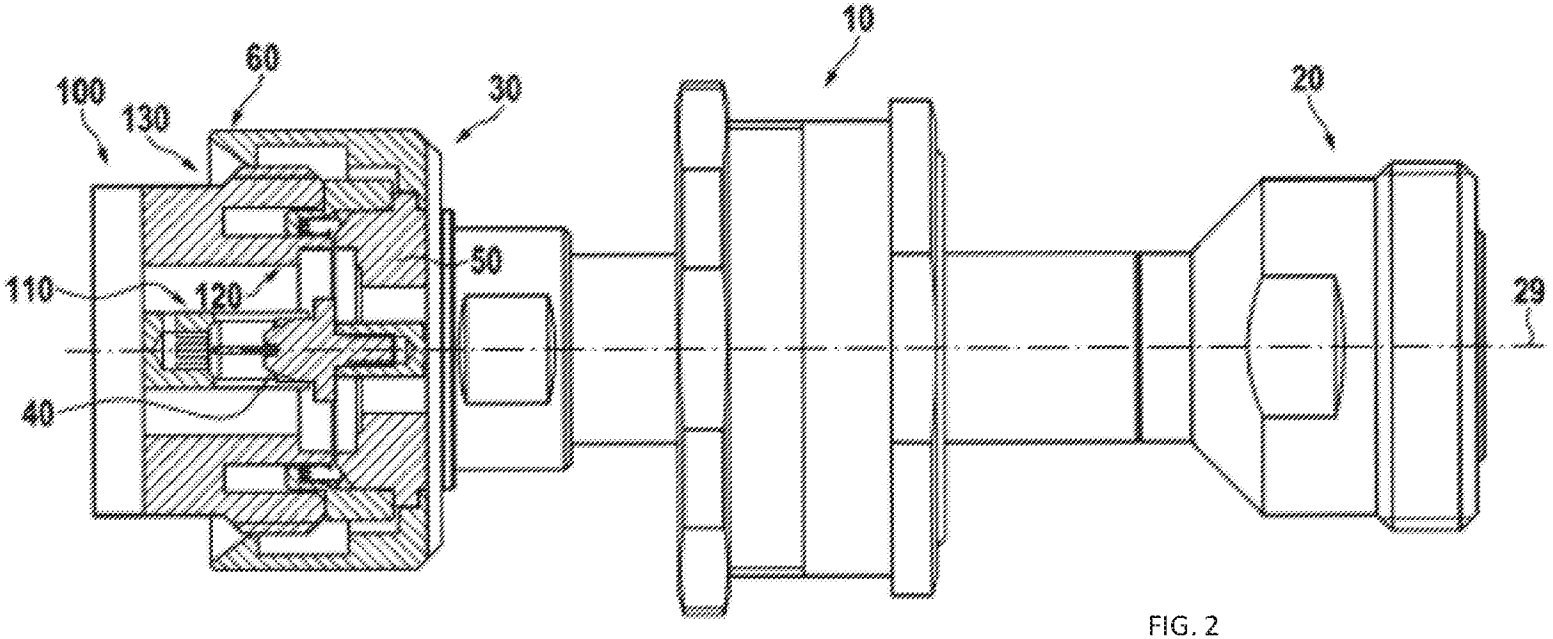
FIG. 2 shows an embodiment of a test connector assembly with attached compatible coaxial connector.

In FIG. 2, a preferred embodiment of a test connector assembly is shown with a compatible coaxial connector 100 attached in an inward direction (from the bottom of the page to the top of the page or the left side of the drawing to the right side). The compatible coaxial connector 100 may either be connected to a cable or to a housing of a device to be tested. The compatible coaxial connector 100 preferably comprises an inner conductor 110 and an outer conductor 120. It is further preferred, if the compatible coaxial connector 100 has an outer housing 130, which further preferably has an outer thread. The outer housing preferably encloses the outer conductor.

Figure 3:
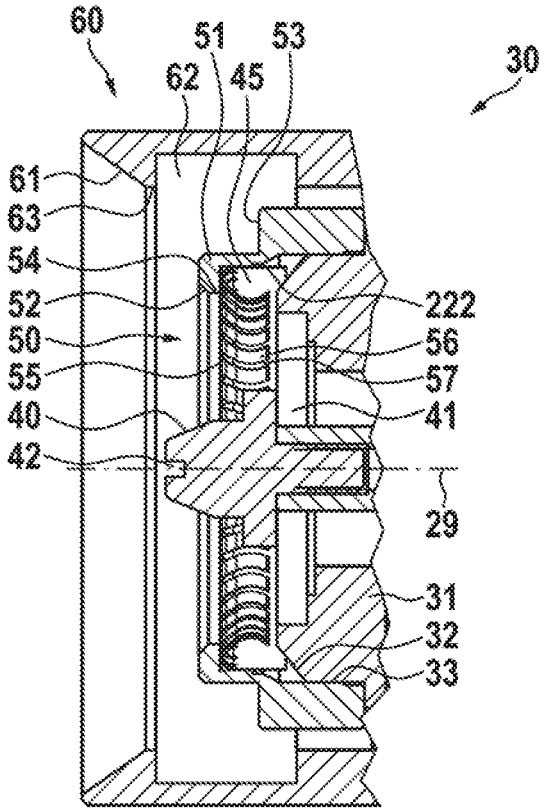
FIG. 3 shows a portion of the test connector in detail.

In FIG. 3, a detail of the test connector 30 is shown in a sectional view. Aligned with the center axis 29, an inner conductor 40 is arranged. In this embodiment, the inner conductor 40 is of a male type, but it may also be of a female type. The specific type of the inner conductor is independent of the contacting of the outer conductor, as will be shown later. The inner conductor 40 may be held by a holding disk 41 which may be of a plastic or ceramic material. It centers the inner conductor 40 within the outer conductor 50. Furthermore, it is preferred, if the center conductor 40 has a slot 42 or a hex drive or any similar means for simplifying assembly of the center conductor to the test connector. The outer conductor 50 comprises a contact spring 55 configured to radially contact the outer conductor of a compatible coaxial connector 100. The contact spring as shown in this preferred embodiment comprises a base 222 holding a plurality of contact fingers 56 with gaps 57 in-between the individual contact fingers. The contact fingers may have additional contact elements or contact points at their outer sides to improve contacting of the compatible coaxial connector 100. Preferably, there is a spring holder 51 which forms a groove, preferably together with the inner side 32, to hold the contact spring 55 at its position at the outer conductor 50. The contact spring 55 is preferably soldered and/or welded to the spring holder 51. The spring holder 51 may either be pressed, welded, soldered or attached by means of the thread 33 to the base 31 of the center conductor.

In an alternate embodiment, the spring holder 51 may be one part with the outer conductor base 31. In this case, it forms a groove 45 configured to hold the contact spring 55. It is further preferred, if the outer conductor 50 has at least one mechanical contacting surface. Most preferably, there is at least one axially oriented mechanical contact section 53. There may be a further mechanical contact section 54 which is oriented radially.

Figure 4:
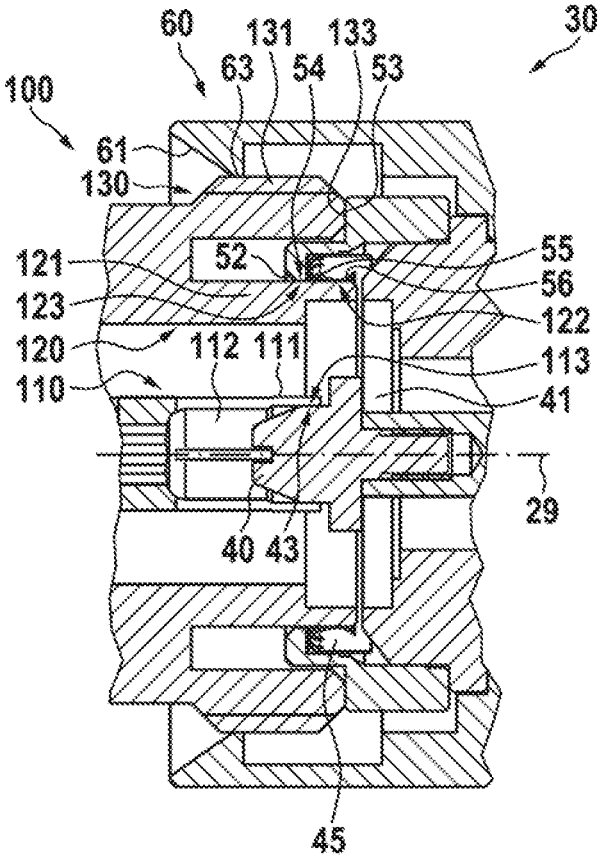
FIG. 4 is a sectional view of a test connector with a mated compatible coaxial connector.

In FIG. 4, a sectional view of a test connector 30 with a mated compatible coaxial connector 100 is shown. The center conductor 110 of the compatible coaxial connector 100 preferably has a center conductor contact element 111 which may be a cylindrical sleeve having slots to provide spring-elastic properties at its end and configured to contact the center conductor 40 at a contact section 43 by its inner contact section 113. The center conductor 110 may enclose an inner space 112 which may be hollow.

The compatible coaxial connector's outer conductor 120 preferably has a hollow end section 121 which is contacted in a radial direction by the contact spring 55 in a contact area 122.

Mechanical alignment of the compatible coaxial connector 100 to the test connector 30 is done by mechanical contact sections at the outer conductor of the test connector and of the compatible coaxial connector 100. For radial alignment, an outer section 123 of the outer conductor of the compatible coaxial connector 100 may contact a radial mechanical contact section 54 of the outer conductor of the test connector. Axial alignment may be done by an axial contact section 133 of the compatible coaxial connector 100 contacting the axially mechanical contact section 53 of the outer conductor of the test connector. Preferably, the axial contact section 133 is part of the housing 130. There may be a chamfer 134 at the edge of the axial contact section 133. Such independent radial and axial alignments ensure proper and reproducible alignment of the connectors. To simplify mating of the connectors, the outer side of the outer conductor 50 may have a chamfer 52. To provide an early alignment during mating of the connectors, a connector guide 60 at the test connector 30 preferably has a cone 61 with an interface section 65 to interface and/or guide the housing 130 and/or an outer thread 131 at the housing.

Figure 5:
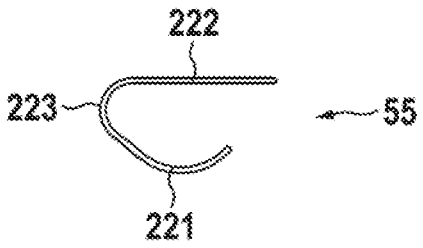
FIG. 5 shows a side view of a section of a contact spring.

In FIG. 5, a side view of a section of a preferred embodiment of a contact spring 55 is shown. The contact spring has a base 222 and a plurality of contact fingers 56, 221 extending therefrom. Preferably, the contact fingers are arc-shaped and provide a first contact section 221 close to the end of the arc and a second contact section 223 between the base and the first contact section. The arcuate shape of the contact fingers allows for smooth insertion and removal of a compatible coaxial connector 100 into and out of the test connector, as shown in FIG. 4. Each of a plurality of the contact fingers acts as an individual spring element and provides a force to the outer conductor of the compatible coaxial connector 100, thus providing an electrical contact. Preferably, the arc has an opening averted to the compatible coaxial connector 100.

Figure 6:
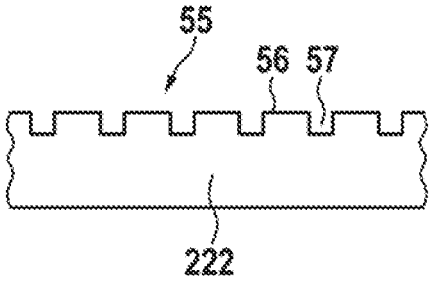
FIG. 6 is a top view of the contact spring.

In FIG. 6, a top view of the contact spring 55 is shown in a straight, extended state. The base 222 holds a plurality of contact fingers 56 extending therefrom with gaps 57 in between. The base preferably has no gaps or slits. Preferably, the contact spring comprises at least one of the following materials: copper-beryllium, brass, steel.

Figure 7:
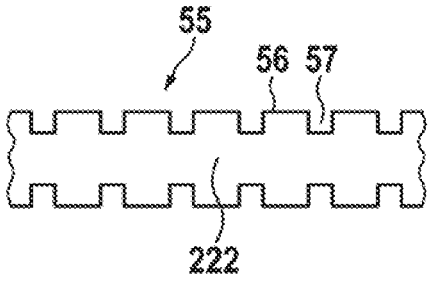
FIG. 7 shows a modified contact spring.

In FIG. 7, a modified contact spring 55 is shown in a straight, extended state. Here, the base 222 is sectioned, which increases flexibility and bendability of the spring.

Figure 8:
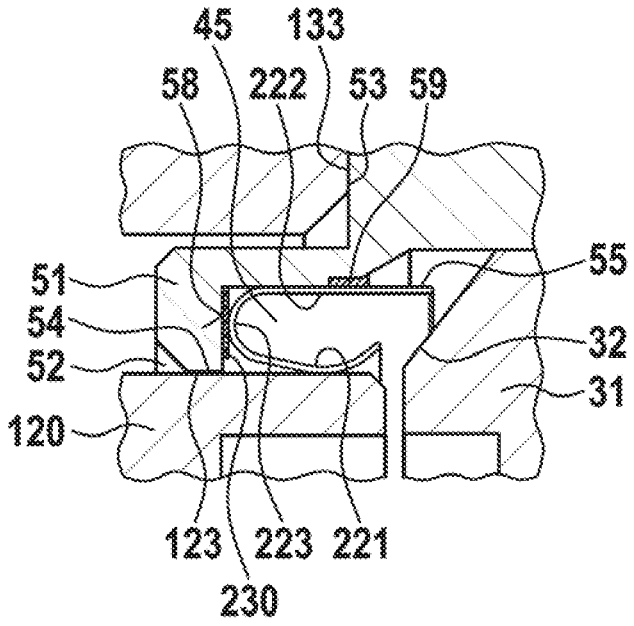
FIG. 8 shows the contact spring in a mated state of the connectors in detail.

In FIG. 8, the contact spring 55 is shown in detail in a mated state of the connectors. As previously mentioned, the contact spring 55 is enclosed between the spring holder 51 and the base 31 of the outer conductor, forming a groove for the contact spring. The contact spring 55 is soldered and/or welded with its base 222 to the spring holder 51. Here, solder 59 is shown radially outside of the base 222 of the contact spring 55. For best intermodulation characteristics, there is only one metallurgical connection (the solder connection) between the contact spring 55 and the spring holder 51. To prevent any galvanic contact and to provide a capacitive contact in an axial direction, an insulating disk 230 may be provided between the second contact section 223 of the contact spring and the sidewall 58 of the spring holder 51. If a galvanic contact is desired, this disc may be omitted. The first contact sections 221 are in contact with the outer conductor 120 of the compatible coaxial connector 100 and generate a highly conductive electrical path thereto. Due to the design of the contact spring 55, high contact forces can be generated towards the outer conductor base 31 of the test connector and towards the outer conductor 120 of the compatible coaxial connector 100, resulting in low passive intermodulation. Preferably, the base 222 of the contact spring 55 is at a larger radius than the contact fingers 221, 223. Therefore, the contact fingers are oriented inwards from the base.

Figure 9:
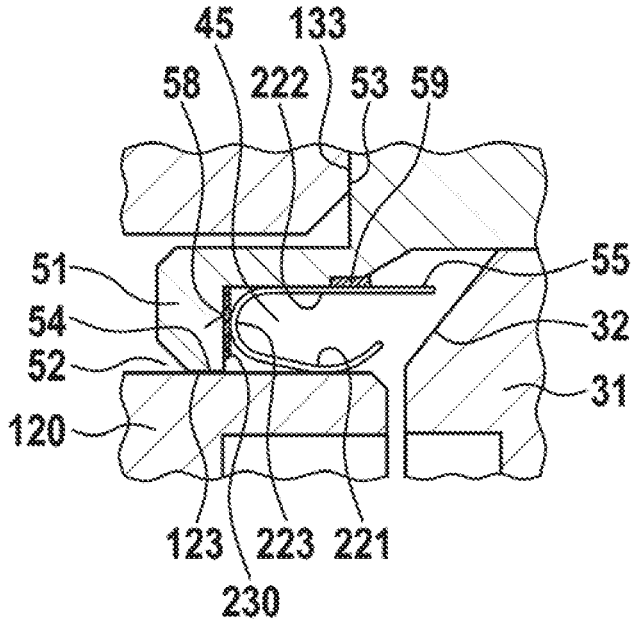
FIG. 9 is a simplified version of FIG. 8.

FIG. 9 is a simplified version of FIG. 7, where some edge lines have been removed to clarify the individual components.

Figure 10:
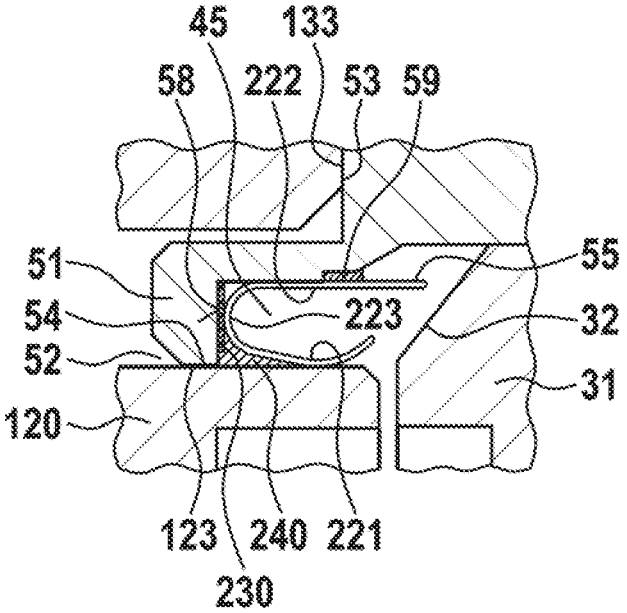
FIG. 10 shows details of the contact area.

FIG. 10 is based on FIG. 9 and shows a further enlarged detail of the contact area. Here, the area 240 forming a current loop by the current flowing from the outer conductor 120 of the compatible connector is marked. It forms a parallel resonance circuit with the capacitance between the surfaces 54 and 123 together with the inductance of the current loop, limiting the bandwidth of the connectors. Due to the capacitive contact by the second contact section 223 to the sidewall 58, the area of this loop can be decreased significantly, which further increases bandwidth of the connector.

Figure 11:
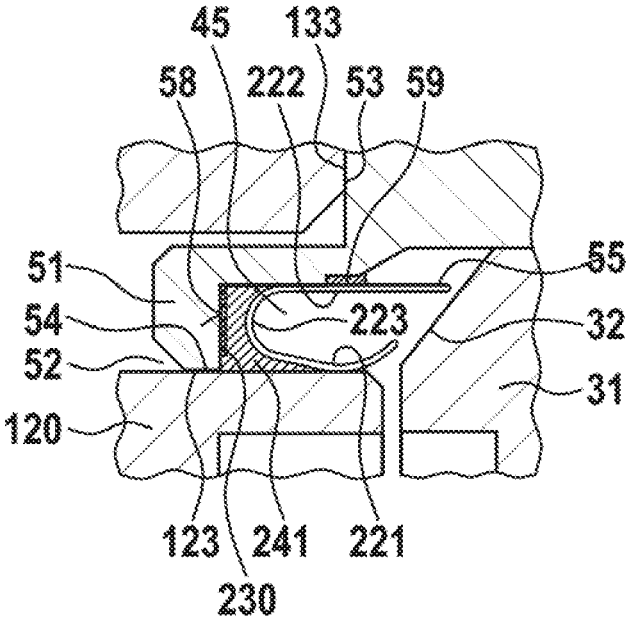
FIG. 11 shows details of a modified contact area.

FIG. 11 shows an embodiment without the capacitive contact by the second contact section 223 to the sidewall 58 resulting in large current loop area 241. A connector with such contacts has significantly less bandwidth than a connector according to FIG. 10.

It will be appreciated to those skilled in the art having the benefit of this disclosure that this invention is believed to provide RF coaxial test connectors. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 mounting suspension
20 internal connector
25 connecting line
29 center axis
30 test connector
31 outer conductor base
32 inner side
33 thread
40 inner conductor
41 holding disk
42 slot
43 conductor contact section
45 groove
50 outer conductor
51 spring holder
52 chamfer
53 axial mechanical contact section
54 radial mechanical contact section
55 contact spring
56 contact fingers
57 gap
58 sidewall
59 solder
60 connector guide
61 cone
65 interface section
100 compatible coaxial connector
110 inner conductor
111 center conductor contact element
112 inner space
113 contact section
120 outer conductor of a compatible connector
121 cylindrical contact section
122 contact area
123 outer section
130 housing
131 outer thread
133 axial contact section
134 chamfer
221 first contact section
222 base
223 second contact section
230 insulating disk
240 small area of current loop
241 large area of current loop

The invention claimed is:

1. A coaxial RF test connector having a center axis and an opening configured to receive a compatible coaxial connector in an inward direction, the coaxial RF test connector comprising:

an inner conductor and an outer conductor, both arranged coaxially with respect to a center axis of said RF test connector, a circularly shaped contact spring held within a groove of the outer conductor, wherein the contact spring includes a base and a plurality of arc-shaped contact fingers extending from the base with gaps between individual arc-shaped contact fingers from said plurality of arc-shaped contact fingers, wherein at least one of the arc-shaped contact fingers from said plurality of arc-shaped contact fingers has a first contact section configured to contact the outer conductor of the compatible coaxial connector in a direction radial with respect to the center axis, a second contact section between the base and the first contact section, the second contact section being configured to form a capcitative contact with a sidewall of the groove, and an insulation disc of a dielectric material between the second contact section and the sidewall of the groove.

2. The coaxial RF test connector according to claim 1, wherein the contact spring is connected to the outer conductor in a radial direction via at least one of soldering or welding.

3. The coaxial RF test connector according to claim 1, wherein the second contact section is in galvanic contact with the sidewall of the groove.

4. The coaxial RF test connector according to claim 1, wherein the sidewall is oriented in an outward direction.

5. The coaxial RF test connector according to claim 1, wherein the base is radially enclosing the contact fingers from said plurality of are-shaped contact fingers.

6. The coaxial RF test connector according to claim 1, wherein the outer conductor comprises a spring holder configured to hold the contact spring.

7. The coaxial RF test connector according to claim 6, wherein the spring holder comprises a first thread counteracting with a second thread at the outer conductor of the test connector, said first thread configured to screw the spring holder onto the outer conductor.

8. The coaxial RF test connector according to claim 1, wherein the contact spring comprises at least one of copper-beryllium, brass, and steel.

9. The coaxial RF test assembly comprising a coaxial RF test connector according to claim 1, further comprising a connecting line held by a mounting suspension, wherein the connecting line is disposed to connect the coaxial RF test connector and the internal connector.

* * * * *